United States Patent [19]

Bacchio

[11] Patent Number: 4,547,936

[45] Date of Patent: Oct. 22, 1985

[54] DRAWING APPARATUS FOR TEXTILE FIBRE WEBS

[75] Inventor: Giovanni Bacchio, Mongrando, Italy

[73] Assignee: Fonderie Officine Riunite Ing. Graziano di L. Graziano & C.S.a.s., Italy

[21] Appl. No.: 613,487

[22] Filed: May 24, 1984

[30] Foreign Application Priority Data

May 24, 1983 [IT] Italy ..... 67575 A/83
Jan. 23, 1984 [IT] Italy ..... 67064 A/84

[51] Int. Cl.[4] ..... D01H 5/24
[52] U.S. Cl. ..... 19/258; 19/259
[58] Field of Search ..... 19/258, 259

[56] References Cited

U.S. PATENT DOCUMENTS 2,023,032 12/1935 Rooney ..... 19/258
3,409,946 11/1968 Whitehurst ..... 19/258
3,748,695 7/1973 Shino et al. ..... 19/258 X
3,942,223 3/1976 Roger ..... 19/258

*Primary Examiner*—Louis K. Rimrodt
*Attorney, Agent, or Firm*—Sughrue, Mion, Zinn, Macpeak and Seas

[57] ABSTRACT

The drawing apparatus for textile fibre webs comprises a series of pairs of rolls, the peripheral velocity of the rolls of each pair being greater than the peripheral velocity of the preceding pair in the direction of advance of the web.

Each roll has a resilient covering constituted by highly flexible steel wires that extend substantially radially. A smaller-diameter smooth roller is interposed between each pair of covered rolls and the following pair, the smaller diameter roller having a peripheral velocity equal to that of the following pair. The disposition of the smooth rollers is such as to impart a sinuous course to the web and keep the web in engagement with the metal wires of the covered rolls over substantial arcs. The drawing apparatus achieves higher drawing ratios with a good quality of the drawn web using a smaller number of pairs of rolls.

10 Claims, 2 Drawing Figures

DRAWING APPARATUS FOR TEXTILE FIBRE WEBS

FIELD OF THE INVENTION

The present invention relates to drawing apparatus for webs of natural or synthetic textile fibres. More particularly, the invention relates to drawing apparatus used in the continuous production of non-woven textiles by drawing of several layers obtained by successive carding and cross-lapping operations.

The drawing apparatus of the invention is of the type comprising several roll pairs, the peripheral velocity of the rolls of each pair being greater than the peripheral velocity of the preceding pair in the direction of advance of the web.

DESCRIPTION OF THE PRIOR ART

In drawing apparatus of this type known from the prior art (see for example British Pat. No. 1,412,732), it has been proposed to use rolls with slightly roughened surfaces to increase the grip of the rolls on the web.

However, such known drawing apparatus needs a large number of pairs of rolls in order to achieve high drawing values and does not allow uniform drawing to be achieved; one result of this is the possible formation of holes in the drawn web.

The object of the present invention is to provide drawing apparatus of the type specified above which allows high drawing ratios to be achieved with a smaller number of pairs of rolls, without prejudicing the quality of the web and particularly without giving rise to holes in the drawn web.

SUMMARY OF THE INVENTION

In order to achieve this object, the present invention provides drawing apparatus of the type specified above in which each of the rolls of each roll pair has a resilient covering constituted by highly flexible steel wires that extend substantially radially, and in that a respective smaller-diameter smooth roller is interposed between each pair of covered rolls and the following roll pair, the peripheral velocity of each smooth roller being equal to that of the following roll pair, and the disposition of the smooth rollers being such as to impart a sinuous path to the web and maintain the web in engagement with the metal wires of the rolls over substantial arcs.

BRIEF DESCRIPTION OF THE DRAWINGS

Further characteristics and advantages of the present invention will become apparent from the description which follows with reference to the appended drawings, provided purely by way of non-limiting example, in which.

DESCRIPTION OF THE PREFERRED EMBODIMENT

Figure 1:
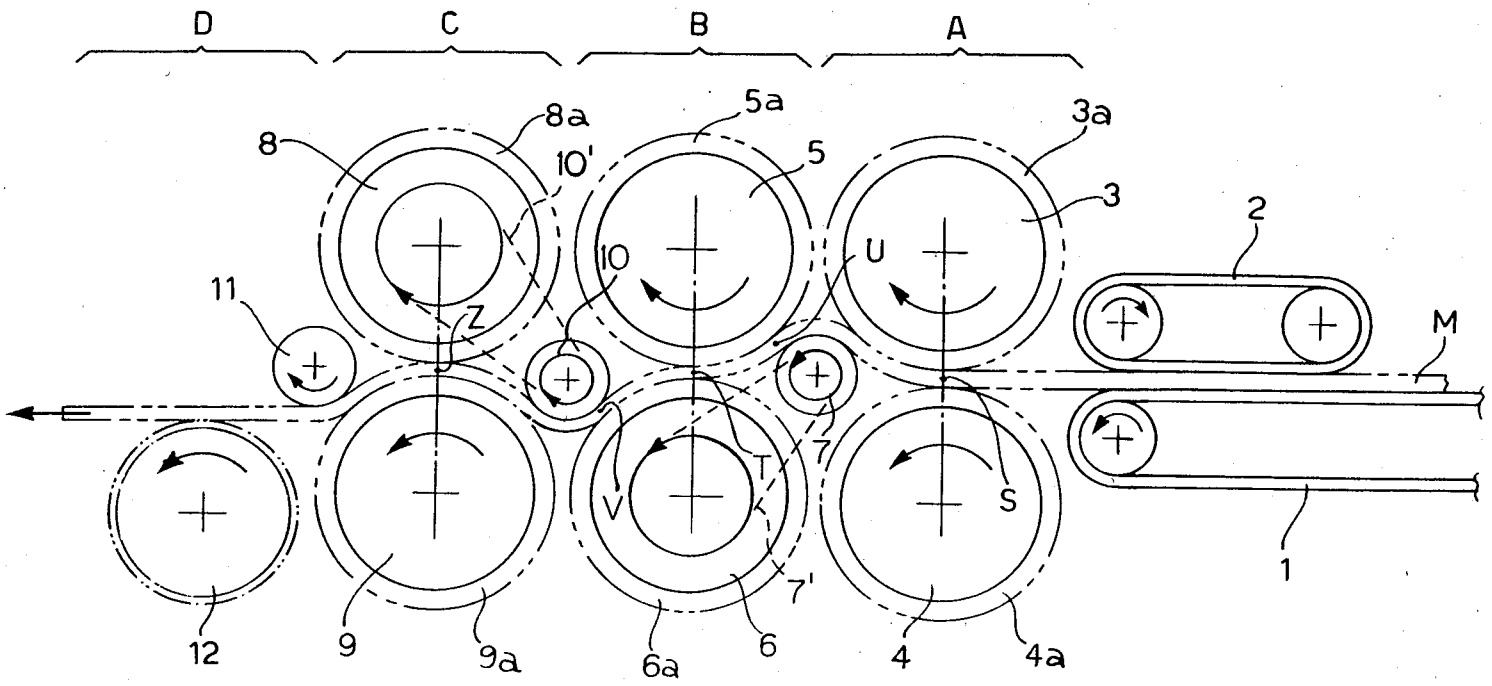
FIG. 1 is a schematic elevational view of drawing apparatus according to the present invention.

The drawing apparatus illustrated in FIG. 1 includes an inlet group A, an intermediate drawing group B, an outlet drawing group C, and an outlet group D.

Reference numeral 1 indicates a conveyor belt which feeds a thick web M continuously to the drawing apparatus, the web M being obtained in known manner by successive carding of textile fibres and lapping of the web leaving the carding machine.

A continuous belt 2 compresses the web M against the conveyor 1 which feeds the web to the inlet group A. The inlet group A is constituted by a pair of rolls 3, 4 each having a resilient covering, respectively 3*a* and 4*a*, constituted by highly flexible steel wires which extend substantially radially.

The rolls 3, 4 are driven by drive means (not shown) such that they have a peripheral velocity slightly greater than the velocity of the belts 1 and 2.

The minimum distance between the resilient coverings 3*a*, 4*a* of the rolls 3, 4 measured in the zone S, that is, in the plane in which the axes of the two rolls lie, is of the order of several millimeters, for example 2–3 millimeters.

The intermediate drawing group B includes a pair of drawing rolls 5, 6 each covered with a resilient covering, respectively 5*a*, 6*a*, and working in conjunction with a smooth roller 7 of smaller diameter which is interposed between the pairs of rolls 3, 4 and 5, 6 and cooperates with the upper rolls 3 and 5.

The minimum distance between the resilient coverings 5*a*, 6*a* of the rolls 5, 6 measured in the zone T is equal to the minimum distance between the coverings of the rolls 3 and 4, while the minimum distance between the covering 5*a* and the roller 7 measured in the zone U is slightly greater and is, for example, 5–10 mm. The minimum distance between the covering 3*a*, and the roller 7 is still greater and is, for example, 10–15 mm.

The numerical values provided above by way of example refer to the case of a web having a weight per unit of surface area at the outlet from the drawing apparatus of between 30 and 100 g/m$^2$. Such values must be increased proportionally for webs having unitary weights above 100 g/m$^2$ at the apparatus outlet.

The rolls 5, 6 and roller 7 are all driven by the drive means including the connecting means 7' at the same peripheral velocity which is greater than that of the rolls 3 and 4.

The intermediate drawing group B may include two or more pairs of drawing rolls instead of a single pair as illustrated. In fact, the number of pairs of drawing rolls may vary in dependence on the maximum drawing ratio which it is desired to achieve, given that in order to achieve high drawing ratios together with a good quality of the web, it is essential to effect drawing in small increments.

The outlet drawing group C is constituted by a pair of rolls 8, 9, both having resilient coverings, respectively 8*a*, 9*a* and working in conjunction with a smooth roller 10 of smaller diameter interposed between the pairs of rolls 5, 6 and 8, 9 and cooperating with the lower rolls 6 and 9.

The minimum distance between the resilient coverings of the rolls 8, 9 measured in the zone Z is equal to the minimum distance between the coverings of the pairs of rolls 3, 4 and 5, 6. The minimum spacing between the covering 6*a* and the roller 10 measured in the zone V is equal to the distance between the covering 3*a* and the roller 7 while the minimum distance between the covering 9*a* and the roller 10 is equal to the minimum distance between the covering 5*a* and of the roller 7 in the zone U.

The rolls 8, 9 and roller 10 are all driven by the drive means including the connecting means 10' at the same peripheral velocity which is greater than that of the rolls 5, 6 and roller 7.

The outlet group D is constituted by rollers 11, 12. The roller 11 which is smooth and of smaller diameter, is adjacent the pair of rolls 8, 9 and cooperates with the roll 9. The roller 12 has transverse rifling or a rigid cover. The rollers 11 and 12 have the same peripheral velocity as that of the rolls 8, 9 and roller 10.

The minimum distance between the covering 9*a* and the roller 11 is equal to the minimum distance between this covering and the roller 10.

Figure 2:
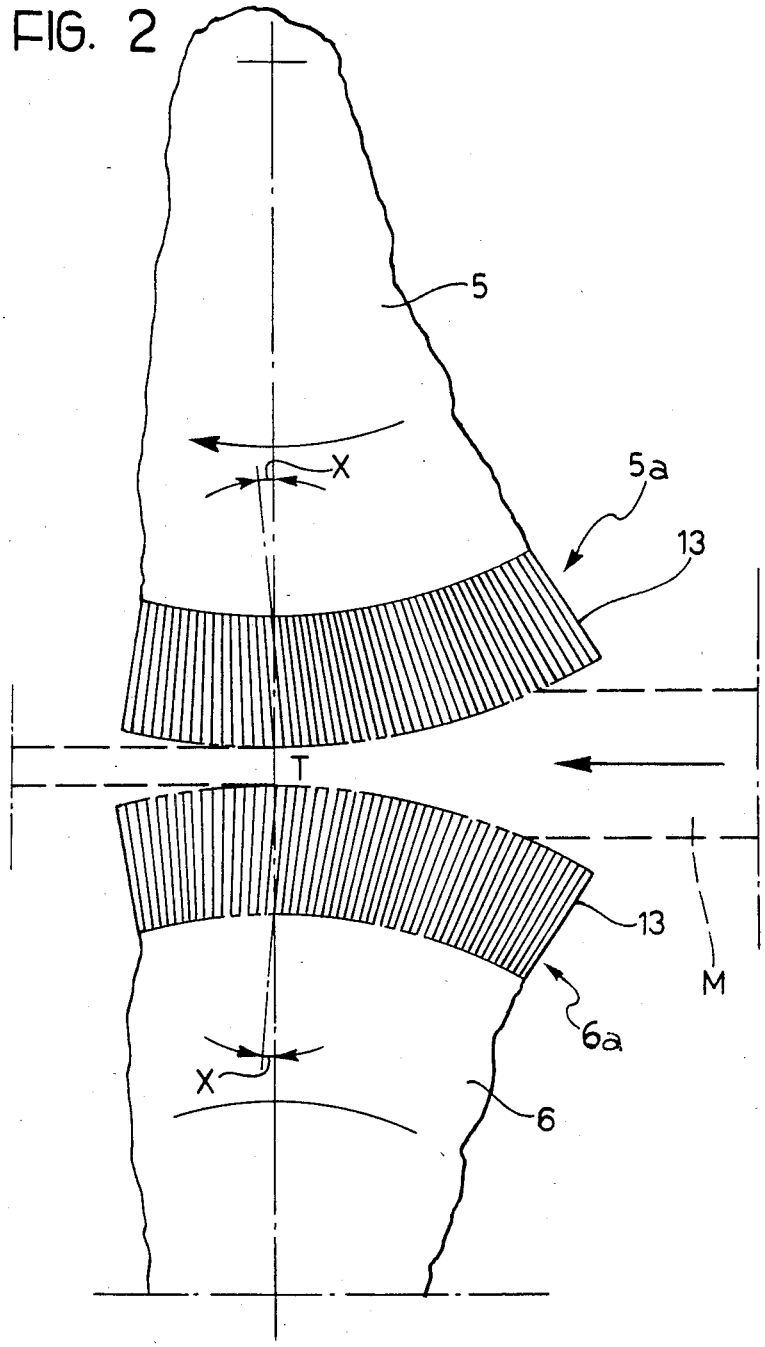
FIG. 2 is a partial view on an enlarged scale of a pair of rolls of the drawing apparatus illustrated in FIG. 1.

FIG. 2 illustrates, in greater detail, the resilient coverings 5*a*, 6*a* provided on the rolls 5, 6 and as stated previously, these coverings are identical to the coverings of the pairs of rolls 3, 4 and 8, 9.

The surface of each of these coverings is made up of a plurality of points each constituted by the end of a circular cross-section metal wire 13 of a diameter of about 0.3 mm. The wires 13 are fixed to four rubber backing webs and have a free length of the order of 23.5 mm. The packing density of the wires is between 20 and 26 wires per square centimeter and is preferably 22 wires per square centimeter.

The wires 13 extend substantially radially and have a small negative inclination, that is, an inclination in the opposite sense to the sense of rotation of the associated roll. In practice, the inclination X of the wires 13 could be between 0° and 10° negative.

The best results have been obtained with a negative inclination of 5°.

The said resilient coverings are of fundamental importance for achieving the objects of the invention.

Indeed each individual wire 13 is able to withstand the pull of the fibres which constitue the web only for very low traction values after which the wire bends freeing the web and thus avoiding the formation of holes in the web itself.

The fact that the wires 13 extend almost radially allows their points to penetrate further into the web and hence gives a deeper action.

In operation of the drawing apparatus according to the invention, the smaller diameter rollers 7, 10 modify the path of the web between the zones S-T and T-Z to make it sinuous and cause pinching of the web at the points U and V.

Furthermore the roller 7 keeps the web in contact with the covering of the rolls 3, 5 and the roller 10 keeps the web in contact with the coverings of the rolls 6, 9.

Drawing occurs between the zones S-U and T-V as a result of the difference in the peripheral velocities from the previous drawing pair. The action of the roller 7 located between the zones S-U and that of the roller 10 between the zones T-V have decisive effects on the drawing.

The roller 7 may be moved closer to, or away from, the roll 5 and the roller 10 may be moved closer to, or away from, the roll 9 in dependence on the thickness of the web M.

The rollers 7 and 10 allow the web to be kept in engagement with the points of the covered roll pairs 3, 4; 5, 6 and 8, 9 over substantial arcs which enables very effective control of the web during drawing to be achieved.

I claim:

1. Drawing apparatus for multi-layer textile fiber webs, said apparatus comprising a plurality of roll pairs, said roll pairs adapted to be driven so that the peripheral velocity of the rolls of each said pair is greater than the peripheral velocity of the preceding pair in the direction of advance of said web, resilient coverings provided around the rolls of each said pair, said coverings being constituted by highly flexible steel wires which extend substantially radially, and, a respective smooth roller positioned between each roll pair and the following roll pair, each said smooth roller being of a smaller diameter than the rolls of said roll pairs and drive means operatively connecting each said smooth roller to an adjacent roller for driving each said smooth roller at a peripheral velocity equal to that of the associated said following roll pair, the arrangement of said smooth rollers being such as to impart a sinuous path to said web and to maintain the web in contact with the roll coverings over substantial arcs.

2. Drawing apparatus according to claim 1 wherein each said covering further includes a resilient backing web from which said wires project, the wires having a length of the order of 23 mm and having a diameter at their radially outer ends of the order of 0.3 mm, each said end constituting a surface point of said covering and the density of said surface points being between 20 and 26 points per square centimeter.

3. Drawing apparatus according to claim 2, wherein the density of said surface points is 22 points per square centimeter.

4. Drawing apparatus according to claim 1, wherein the said wires constituting said coverings have a negative inclination of between 0° and 10° with respect to the direction of rotation of the associated rolls.

5. Drawing apparatus according to claim 4, wherein said wires have a negative inclination of 5°.

6. Drawing apparatus according to claim 1, wherein the said smooth rollers cooperate alternately with the upper rolls and the lower rolls of the said pairs of rolls between which they are interposed.

7. Drawing apparatus according to claim 1, wherein the minimum distance between the coverings of the rolls of each said roll pair is of the order of several millimeters.

8. Drawing apparatus according to claim 7, wherein the minimum spacing between each said smooth roller and the said coverings of the two rolls with which it cooperates is greater than the said minimum distance between the said coverings of the rolls of each said pair.

9. Drawing apparatus according to claim 8, wherein the minimum spacing between each said smooth roller and the said covering of the cooperating roll that precedes it in the direction of advance of said web, is greater than the minimum spacing between the smooth roller and the covering of the cooperating roll that follows it in the said direction of advance of the web.

10. Drawing apparatus according to claim 1 wherein the distance between the axes of two corresponding draw rolls of two adjacent roll pairs is substantially equal to but slightly greater than the diameter of each said covering measured from the ends of said wires which extend substantially radially from each said covering.

* * * * *